US009921539B2

(12) United States Patent
Zhou

(10) Patent No.: US 9,921,539 B2
(45) Date of Patent: Mar. 20, 2018

(54) DRIVING ASSEMBLY AND DEVELOPING CARTRIDGE

(71) Applicant: ZHUHAI UN-TERN IMAGING PRODUCTS CO., LTD., Zhuhai (CN)

(72) Inventor: Honghui Zhou, Zhuhai (CN)

(73) Assignee: Zhuhai Un-Tern Imaging Products Co., Ltd., Zhuhai (CN)

( * ) Notice: Subject to any disclaimer, the term of this patent is extended or adjusted under 35 U.S.C. 154(b) by 43 days.

(21) Appl. No.: 15/279,817

(22) Filed: Sep. 29, 2016

(65) Prior Publication Data

US 2018/0017933 A1 Jan. 18, 2018

(30) Foreign Application Priority Data

Jul. 13, 2016 (CN) ..... 2016 1 0562291

(51) Int. Cl.
*G03G 21/16* (2006.01)
*G03G 15/08* (2006.01)

(52) U.S. Cl.
CPC ..... *G03G 21/1647* (2013.01); *G03G 15/0865* (2013.01)

(58) Field of Classification Search
CPC ..... G03G 21/1647; G03G 21/1857; G03G 21/186; G03G 21/1864; G03G 15/757; G03G 2221/1657
See application file for complete search history.

(56) References Cited

U.S. PATENT DOCUMENTS

2015/0050050 A1* 2/2015 Huang ..... G03G 21/1857 399/167
2015/0153701 A1* 6/2015 Huang ..... G03G 15/757 399/167
2016/0231688 A1* 8/2016 Huang ..... G03G 21/1857
2016/0282798 A1* 9/2016 Matsuoka ..... G03G 15/757
2017/0227918 A1* 8/2017 Huang ..... G03G 21/1647

FOREIGN PATENT DOCUMENTS

CN 201945803 U 8/2011

* cited by examiner

*Primary Examiner* — Sevan A Aydin
(74) *Attorney, Agent, or Firm* — Workman Nydegger

(57) ABSTRACT

The present disclosure discloses a driving assembly. The driving assembly is configured to be arranged on one end of a developing cartridge, the driving assembly comprises a connector configured to engage with a driving head of an electrophotographic image forming apparatus. The connector comprises a sleeve, a guide rod, and at least one engaging claw. The sleeve has a protrusion portion at its distal end relative to the developing cartridge, the protrusion portion axially projects outwards and has a limiting groove with an outwards opening; the engaging claw is hinged at the second end of the guide rod; when the driving assembly rotates upon receiving driving forces, a side surface of the limiting groove contacts a side surface of the engaging claw. A developing cartridge comprising the driving assembly is also provided.

20 Claims, 6 Drawing Sheets

DRIVING ASSEMBLY AND DEVELOPING CARTRIDGE

CROSS REFERENCE TO RELATED APPLICATIONS

This application claims the benefit of the priority of Chinese Patent Application No. 201610562291.2, filed on Jul. 13, 2016, entitled "Driving Assembly and Developing Cartridge", the entire contents of which are incorporated herein by reference.

TECHNICAL FIELD

The present disclosure relates to the field of electrophotographic image forming technology, more particularly, to a driving assembly configured to be arranged in an electrophotographic image forming apparatus to transmit driving forces, and to a developing cartridge having the driving assembly.

BACKGROUND

The imaging principle of the electrophotographic image forming apparatus (also referred to as an electronic imaging device) is as follows: firstly, uniformly charge the photosensitive material coated surface of the photosensitive drum or the photosensitive tape; then expose the surface of the photosensitive drum or the photosensitive tape with laser beams, then the electric charges on the exposed region disappear, and the electric charges on the other regions unexposed form an electrostatic latent image; then the developing agent like carbon powder is supplied to the electrostatic latent image by a developing roller or other components, so as to develop the latent image; then the image is transferred to a print medium, and fixed by heating, thereby forming a stable image on the print medium.

In general, the electrophotographic image forming apparatus is provided with a detachable developing cartridge. Based on different design concepts, the manufacturers of electrophotographic image forming apparatus will integrate more or less processing components in the developing cartridge. For example, some manufacturers integrate a photosensitive drum, a developing device, a charging device and a cleaning device together to form an integral box, and some manufacturers integrate the photosensitive drum and the charging device together, or integrate the photosensitive drum and the developing device together to form various kinds of split boxes. Regardless of the integration modes, as long as the box is provided with any one of processing members which are required to rotate in the process of image forming, the box needs to be supplied with driving forces, so as to drive the processing components to rotate.

One of the existing driving members is designed to be a universal joint type. One end of the driving member is arranged in a cylindrical member disposed on an end part of the developing cartridge, and the other end of the driving member projects outward from the developing cartridge, so as to engage with the driving shaft of the electrophotographic image forming apparatus. When the driving member is mounted onto or detached from the electrophotographic image forming apparatus, the driving member deflects to one side relative to the axis of the cylindrical member, in order to avoid forming interference with the driving shaft. The cylindrical member may be arranged at an end of the photosensitive drum or at an end of the developing roller, and after receiving driving forces, the universal joint directly drives the photosensitive drum or the developing roller to rotate. The cylindrical member may alternatively be arranged at other positions parallel to the axis of the photosensitive drum or the developing roller, and the driving forces are transmitted to the processing components like the photosensitive drum or the developing roller through a gear assembly. This type of universal joint driving member is apt to drop out of the cylindrical member, and driving forces cannot be transmitted stably.

In order to solve the problem that this type of universal joint driving member is apt to fall off, the driving member of the exiting developing cartridge typically adopts an axially moveable connector arranged in the cylindrical member. When the connector is mounted or detached, as the driving shaft, namely the driving head, in the electrophotographic image forming apparatus abuts against the connector, the connector moves inwards to avoid interference with the driving shaft. When the developing cartridge is mounted into its position, under the action of a spring or gas pressure, the connector moves outwards and engages with the driving shaft of the electrophotographic image forming apparatus, thereby driving the driving force receiving components to rotate, such as the photosensitive drum, the developing roller, and so on. But sometimes, the axial movement of the connector is limited by other members in the electrophotographic image forming apparatus, therefore the developing cartridge cannot be detached easily. If the developing cartridge is forcibly mounted or detached, there will be a risk that the driving member cannot engage with the driving shaft of the electrophotographic image forming apparatus stably, and driving forces cannot be transmitted stably.

Chinese utility model patent No. 201120045210.4 disclosed a driving assembly, wherein, the contact head of the driving assembly is connected at a gap of the bracket body through a pivot and a rebound-reset element. When the driving assembly rotates upon receiving driving forces from the driving head of the electrophotographic image forming apparatus, the acting forces are transmitted to the bracket body through the contact head and the pivot, as a result the driving forces cannot be transmitted stably. Additionally, due to the space limitation of the gap, the pivot is usually quite thin, consequently, when the driving assembly rotates upon receiving driving forces from the driving head of the electrophotographic image forming apparatus, due to the torque generated by the rotation, the pivot is apt to be damaged. Moreover, it is not easy to install the contact head and the rebound-reset element due to the space limitation of the gap.

SUMMARY OF THE INVENTION

A first objective of the present disclosure is to provide a driving assembly, which is easy to operate, and has stable structure, thereby the developing cartridge can be installed and detached conveniently, and driving forces can be transmitted stably.

A second objective of the present disclosure is to provide a developing cartridge, which is easy to operate, robust in structure, convenient to install and detach, and can transmit driving forces stably.

In order to achieve the first objective above, the present disclosure provides a driving assembly. The driving assembly is configured to be arranged on one end of a developing cartridge, and comprises a connector which is configured to engage with a driving head of an electrophotographic image forming apparatus. Wherein, the connector comprises a sleeve, having a protrusion portion at its distal end relative to the developing cartridge, said protrusion portion axially projects outwards and has a limiting groove with an outwards opening; a guide rod, having a first end arranged in the sleeve and a second end projecting outwards from the sleeve, said guide rod is coaxial with the sleeve and is capable of reciprocating axially relative to the sleeve; at least one engaging claw hinged at the second end of the guide rod; and when the driving assembly rotates upon receiving driving forces, a side surface of the limiting groove contacts a side surface of the engaging claw.

As can be seen from the scheme above, the driving assembly receives the driving forces from the electrophotographic image forming apparatus through the connector engaging with the driving shaft of the electrophotographic image forming apparatus. In the process of transmitting driving forces, the side surface of the limiting groove contacts the side surface of the engaging claw, and the driving forces are transmitted from the engaging claw to the sleeve. On one hand, the intermediate mechanisms for transmitting the driving forces are reduced, on the other hand, the engaging claw is ensured not to drop out of the limiting groove easily, thereby ensuring that the driving forces are transmitted more stably. One end of the engaging claw is hinged at the second end of the guide rod, which enables the engaging claw to rotate around an axis perpendicular to the axis of the guide rod. When the developing cartridge is detached from the electrophotographic image forming apparatus, the driving assembly moves relative to the driving shaft, and the driving shaft forces the engaging claw to deflect, so as to avoid forming interference between the engaging claw and the driving shaft, and to enable the driving shaft to be detached from the driving assembly, which is convenient for detaching the developing cartridge. The deflection of the engaging claw makes the guide rod move axially and outwards, and make the deflection angle of the engaging claw increase, further avoiding forming interference with the driving shaft.

In one of the embodiments, at least two engaging claws are provided symmetrically with respect to the guide rod; the engaging claws are hinged at the second end of the guide rod through a pivot or a hinge; and free ends of the engaging claws axially project outwards along the axis of the guide rod.

As can be seen from the scheme above, at least two engaging claws are provided symmetrically with respect to the guide rod, which is not only convenient for installing, but also ensures that the guide rod and the driving assembly receive balanced forces and that the driving forces are transmitted stably. When the pivot is connected, the pivot may be arranged to be perpendicular to the axis of the guide rod. The side surface of the engaging claw abuts against the side surface of the limiting groove to transmit the driving forces from the guide rod to the sleeve. The engaging claw of the guide rod can rotate around the pivot. When the engaging claw abuts against the driving shaft, the guide rod moves axially and outwards, and the deflection angle of the engaging claw increases, and the axial length of the outwardly projecting engaging claw decreases, thereby avoiding forming interference with the driving shaft, and the driving shaft is detached from the driving assembly. The driving assembly is easy to operate, robust in structure, thereby it is convenient for installing and detaching the developing cartridge, and driving forces can be transmitted stably.

In one of the embodiments, along with axial and outwards movement of the guide rod, a deflection angle of the engaging claw relative to the axis of the guide rod increases, and the axial length of outwardly projecting engaging claw decreases.

As can be seen from the scheme above, when the engaging claw rotates around the pivot, the engaging claw rotates in the plane containing the axis of the guide rod or in the plane which is parallel to the axis of the guide rod. When the position of the guide rod relative to the sleeve changes, the deflection angle of the engaging claw will be varied at a larger magnitude, and the axial length of the outwardly projecting engaging claw will be varied at a larger magnitude, thereby, it is easy to realize detaching the driving shaft from the driving assembly or engaging the driving shaft with the driving assembly.

In one of the embodiments, the driving assembly further comprises a cylindrical member, configured to be arranged at one end of the developing cartridge; a force exerting device is provided in the cylindrical member; wherein, the connector has a connecting end arranged inside the cylindrical member and a free end axially projecting outwards from the cylindrical member and out of the developing cartridge; under actions of forces exerted on the connecting end of the connector by the force exerting device, the connector moves axially along the axis of the cylindrical member; a first limiting structure is configured on the cylindrical member to prevent the connecting end of the connector from dropping out of the cylindrical member.

As can be seen from the scheme above, during the process of installing or detaching the developing cartridge, the driving shaft of the electrophotographic image forming apparatus abuts against the connector, so that the connector moves inwardly to avoid forming interference with the driving shaft. When the developing cartridge is installed in position, the force exerting device pushes the connector to move outwardly to engage with the driving shaft of the electrophotographic image forming apparatus, thereby transmitting the driving forces stably. The first limiting structure is configured on the cylindrical member to prevent the connecting end of the connector from dropping out of the cylindrical member, and thus, the connector is not apt to drop out of the cylindrical member.

In one of the embodiments, a biasing device is arranged in the sleeve to exert axial biasing forces on the guide rod.

As can be seen from the scheme above, the biasing device forces the guide rod to be in an initial position relative to the sleeve. The axial acting forces exerted on the guide rod by the biasing device may be outwards, or inwards. When the axial acting forces exerted on the guide rod by the biasing device are outwards, the biasing device forces the guide rod to be in an axial and outwards position. In this case, the deflection angle of the engaging claw is larger and the axial length of the outwardly projecting engaging claw is smaller. When the engaging claw engages with the driving shaft, the driving shaft abuts against the engaging claw, forcing the guide rod move inwardly, and forcing the axial length of the outwardly projecting engaging claw to increase. The outwardly projecting engaging claw contacts the curved projection of the driving shaft, so as to transmit driving forces. When the axial acting forces exerted on the guide rod by the biasing device are inwards, the biasing device forces the guide rod to be in an axial and inwards position. In this case, the deflection angle of the engaging claw is smaller and the axial length of the outwardly projecting engaging claw is larger. When the driving shaft releases from the driving assembly, the driving shaft abuts against the engaging claw, forcing the engaging claw to rotate, driving the guide rod to overcome the biasing forces and to move axially and outwardly, as a result, the axial length of the outwardly projecting engaging claw decreases, and the driving shaft and the engaging claw are disengaged from each other. Wherein, the biasing device has an additional function of limiting the position, that is, limiting the axial movements of the guide rod relative to the sleeve. Additionally, a second limiting structure may be configured on the sleeve or on the guide rod to limit axial movements of the guide rod relative to the sleeve. The second limiting structure enables the guide rod not to drop out of the sleeve easily, maintaining the connection between the sleeve and the guide rod while allowing the relative axial movement therebetween. Wherein, the biasing device may be used as one of the implementations of the second limiting structure.

In one of the embodiments, the biasing device is one or more of a metallic elastic device, a non-metallic elastic device, a magnetic device, a gas hermetic device, or a liquid hermetic device. As can be seen from above, various implementations are possible as long as the biasing device can provide axial biasing forces.

In order to achieve the second objective of the present disclosure, a developing cartridge is provided, comprising the driving assembly of the present disclosure as described above.

In one of the embodiments, the developing cartridge further comprises a photosensitive drum; the driving assembly is arranged at an end of the photosensitive drum; and the guide rod of the driving assembly is coaxial with the photosensitive drum.

In one of the embodiments, the developing cartridge further comprises a developing roller; the driving assembly is arranged at an end of the developing roller; and the guide rod of the driving assembly is coaxial with the developing roller.

DETAILED DESCRIPTION OF THE PREFERRED EMBODIMENTS

The present disclosure will be described in more details with reference to the accompanying figures and embodiments.

Figure 1:
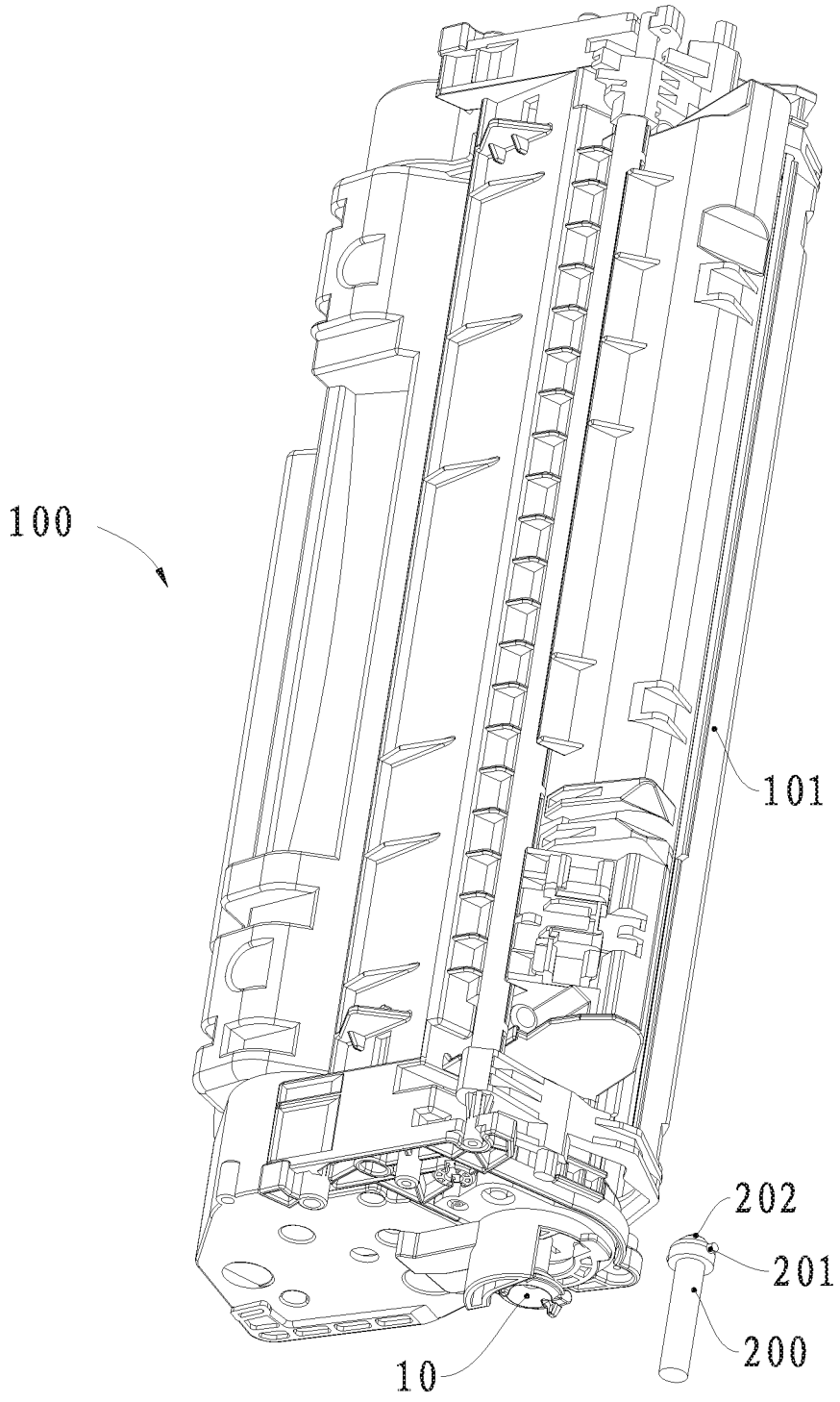
FIG. 1 is a structural schematic diagram of the developing cartridge according to one embodiment of the present invention, also illustrates the driving shaft of the electrophotographic image forming apparatus.
Figure 2:
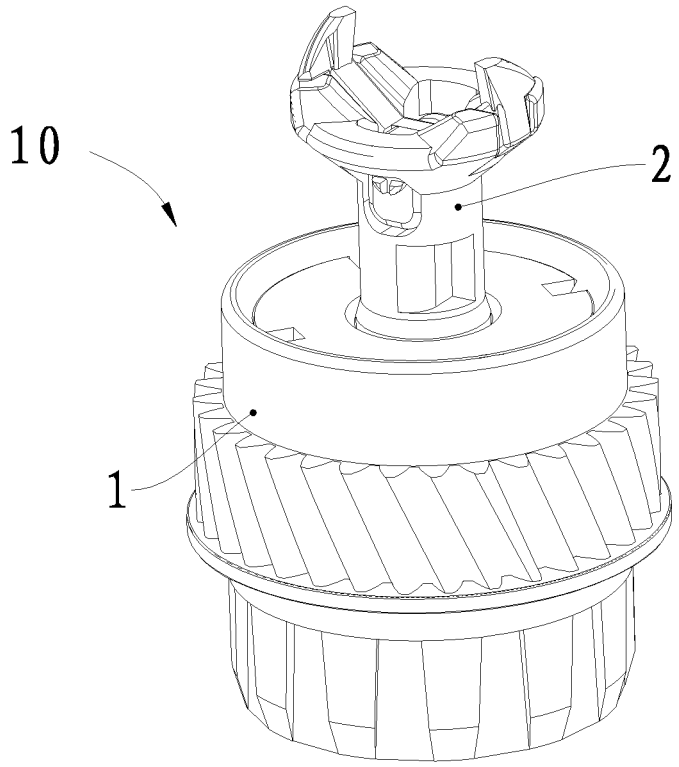
FIG. 2 is a structural schematic diagram of the driving assembly according to one embodiment of the present invention.
Figure 3:
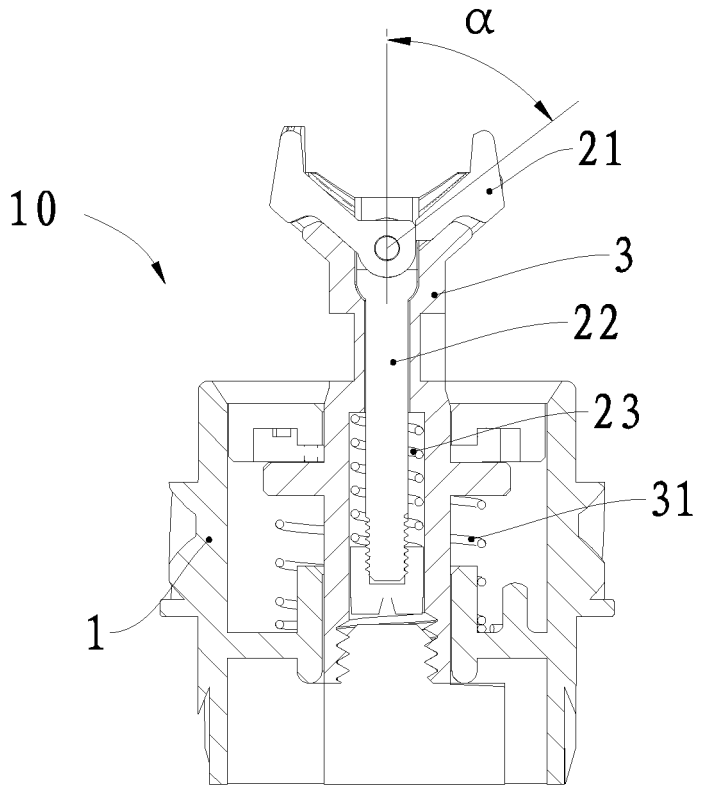
FIG. 3 is a sectional schematic diagram of the driving assembly as shown in FIG. 2.
Figure 4:
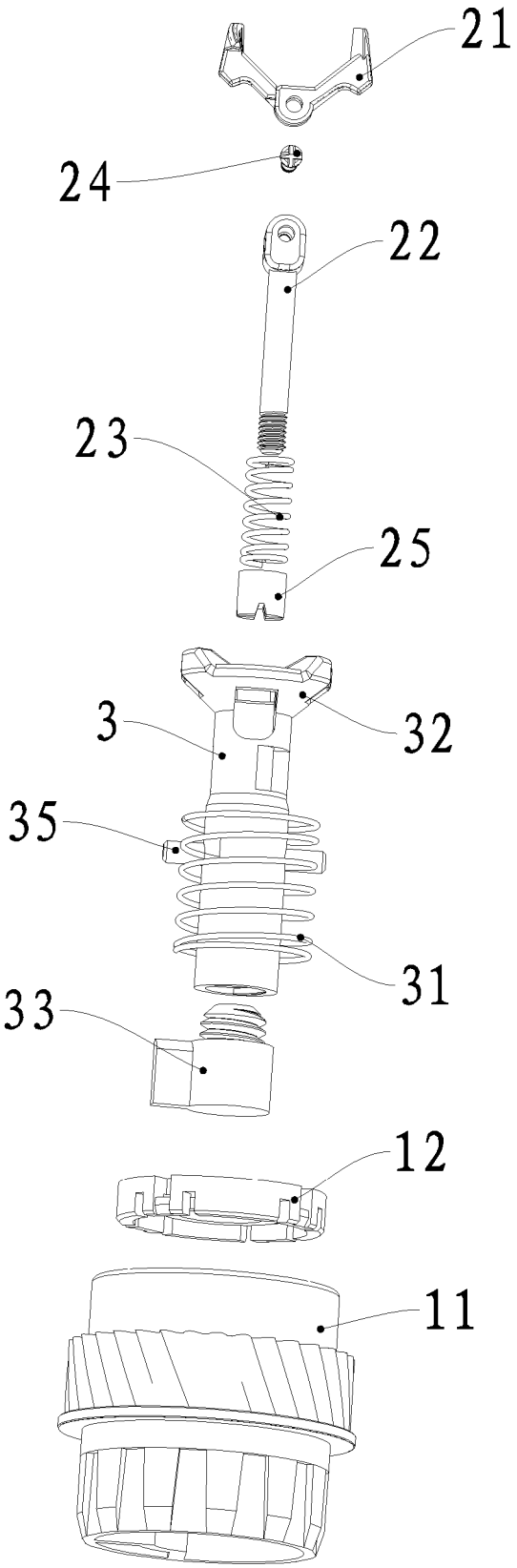
FIG. 4 is an exploded structural schematic diagram of the driving assembly as shown in FIG. 2.
Figure 5:
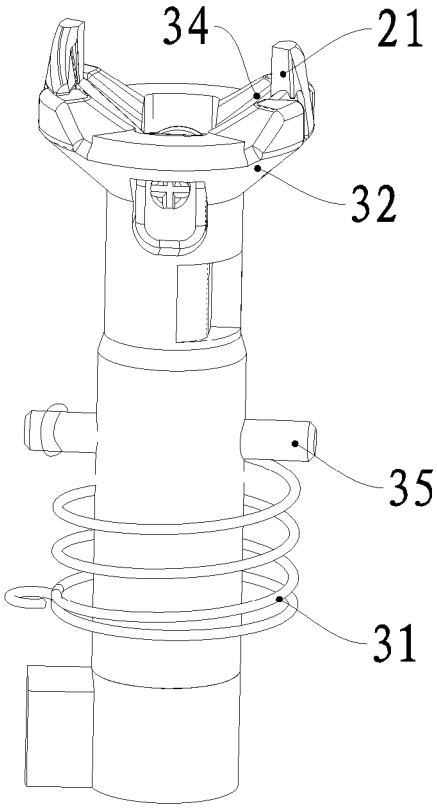
FIG. 5 is a structural schematic diagram of the connector of the driving assembly according to one embodiment of the present invention.

As shown in FIG. 1, the developing cartridge 100 includes a box body 101 and a driving assembly 10. The driving assembly 10 is arranged on one longitudinal end of the box body 101, for engaging with a driving shaft 200 (namely, the driving head) of the electrophotographic image forming apparatus, in order to transmit driving forces to the processing components in the developing cartridge 100. The driving shaft 200 has a radial projection 201 at its one end. The developing cartridge 100 may accommodate components such as a photosensitive drum, a developing roller, and a powder feeding roller. The driving assembly 10 is coaxially arranged at one end of the photosensitive drum or at one end of the developing roller, thereby receiving driving forces to drive the photosensitive drum or the developing roller to rotate. Alternatively, the driving assembly 10 is arranged neither coaxially with the photosensitive drum nor with the developing roller, but the axis of the driving assembly is parallel to the axis of the photosensitive drum or the axis of the developing roller, thereby, after receiving the driving forces, the driving assembly drives other components to rotate through a gear assembly. In the embodiments of the developing cartridge of the present disclosure, other components, except the driving assembly, are substantially the same as those in the prior art developing cartridge, therefore, a further description will be made below with respect to the implementations of the driving assembly, and the embodiments of the developing cartridge may be provided with any one of the implementations of the driving assembly.

As shown in FIGS. 2, 3, 4, and 5, the driving assembly 10 includes a cylindrical member 1 and a connector 2, which are arranged coaxially. The connecting end of the connector 2 is arranged inside the cylindrical member 1, and the free end of the connector 2 axially projects outwards from the cylindrical member 1. The fixed end of the cylindrical member 1 is coaxially arranged on the end of the photosensitive drum or on the end of the developing roller, or on other components of the developing cartridge. Gears are provided on the outer wall of an intermediate section of the cylindrical member 1 so as to engage with gears of other members, thereby transmitting the driving forces received by the driving assembly to other members. The free end of the cylindrical member 1 has an opening, and the connector 2 projects axially outwards from the opening. Additionally, a limiting cover 12 is provided at the opening, and a limiting projection 35 is configured on the connector 2 to prevent the connector 2 from dropping out of the cylindrical member 1. The implementation with the limiting cover 12 and the limiting projection 35 is one embodiment of the limiting structure, and it should be understood that other implementations are possible for the limiting structure. The spring 31, as one implementation of the force exerting device, is configured to exert axial and outwards forces on the connector 2. In other implementations, the force exerting device may be embodied as a magnetic device, or non-metallic elastic material, etc.

The connector 2 includes a guide rod 22 and a sleeve 3, which are arranged coaxially. The guide rod 22 is capable of reciprocating axially relative to the sleeve 3. A limiting structure is configured on the sleeve 3 or on the guide rod 22 to limit axial movements of the guide rod 22 relative to the sleeve 3, thereby preventing the guide rod 22 from dropping out of the sleeve 3. The guide rod 22 has a first end arranged inside the sleeve 3, and a second end projecting outwards from the sleeve 3. A pivot 24 is provided on the second end. Two engaging claws 21, which are capable of rotating around the pivot 24, are installed (namely, hinged) on the second end of the guide rod 22. The pivot 24 is perpendicular to the axis of the guide rod 22, such that, the engaging claws 21 can rotate in the plane containing the axis of the guide rod 22, and the free ends of the engaging claws 21 axially project outwards. When the deflection angle, which is formed between the engaging claw 21 on the second end of the guide rod 22 and the axis of the guide rod 22, increases, the axial length of the outwardly projecting engaging claw 21 decreases. For example, the deflection angle of the engaging claw 21 relative to the axis of the guide rod 22 can be defined as an acute angle α formed by the engaging claw 21 relative to a plane, said plane is parallel to or contains the axis of the guide rod 22, and is perpendicular to a second plane formed by the rotation of the engaging claw 21; or said plane contains the pivot of the engaging claw 21, and is parallel to or contains the axis of the guide rod 22. A head. 33 is provided on the connecting end of the sleeve 3 to seal the connecting end. The free end of the sleeve 3, which is the distal end relative to the developing cartridge, is provided with a protrusion portion 32, the protrusion portion 32 axially projects outwards and has a limiting groove 34 opening outwards. The first end of the guide rod 22 is provided with a head 25, which radially projects outwards. A spring 23 is sleeved around the guide rod 22. One end of the spring 23 abuts against the head 25, and the other end abuts against the inner wall of the sleeve 3. The spring 23, as one implementation of the biasing device, is configured to exert axial and inwards biasing forces on the guide rod 22. The engaging claw 21 is partially accommodated in the limiting groove 34, and the protrusion portion 32 of the sleeve 3 limits the maximum deflection angle of the engaging claw 21 to some extent, thereby limiting the axial length of the outwardly projecting engaging claw 21.

Figure 6:
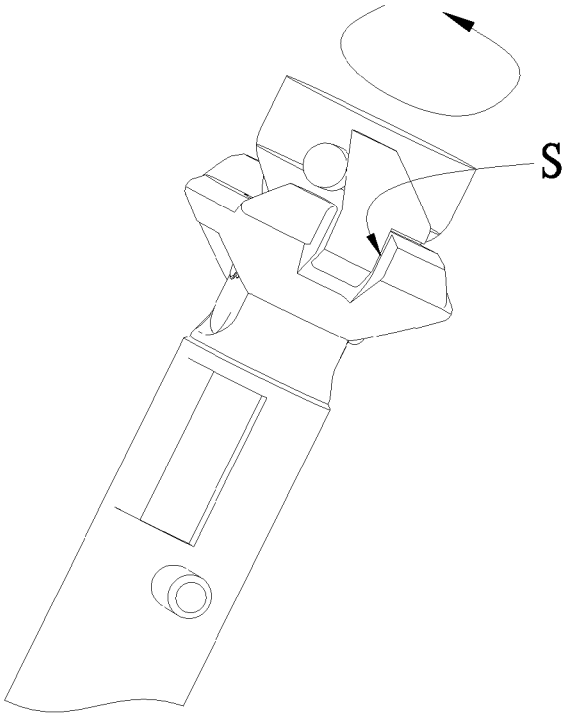
FIG. 6 is a schematic diagram illustrating the working status of the connector as shown in FIG. 5.

When the developing cartridge is mounted on the electrophotographic image forming apparatus, the sleeve 3 of the connector 2 outwardly projects the maximum distance under the action of the spring 31, and the guide rod 22 axially moves the maximum distance inwardly under the action of the spring 23. When the sleeve 3 of the connector 2 abuts against the curved projection 202 arranged at the end of the driving shaft 200, under the pushing of the curved projection 202, the connector 2 moves into the cylindrical member 1 against the three of the spring 31. When the end of the guide rod 22 abuts against the curved projection 202, the sleeve 3 of the connector 2 will move outwards under the action of the spring 31. The curved projection 202 pushes against the guide rod 22, and the engaging claws 21 get closer to the driving shaft 200. When the driving shaft 200 rotates, the engaging claws 21 engage with the radial projection 201 of the driving shaft 200, and side surface of the engaging claw 21 abuts against the side surface of the limiting groove 34 to drive the guide rod 22 and the sleeve 3 to rotate, and thus the driving assembly rotates. In this embodiment, as shown in FIG. 6, the contact surface S is located downstream along the rotation direction. In practical applications, the contact can be a point contact, a line contact or a surface contact. In this embodiment, the contact is the surface contact, so that the driving forces are transmitted more stably.

Figure 7C:
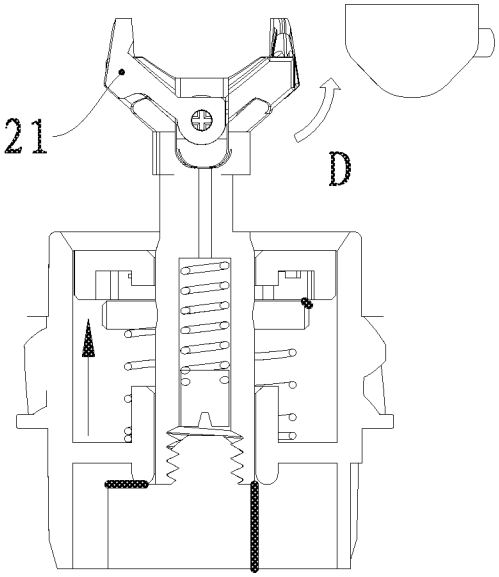
FIGS. 7*a*-7*c* are schematic diagrams illustrating the movement of the driving assembly when the developing cartridge is taken out of the electrophotographic image forming apparatus according to one embodiment of the present invention.
Figure 7B:
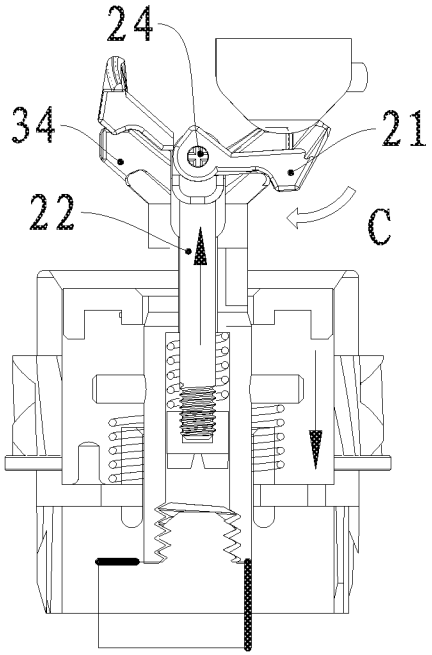
Figure 7A:
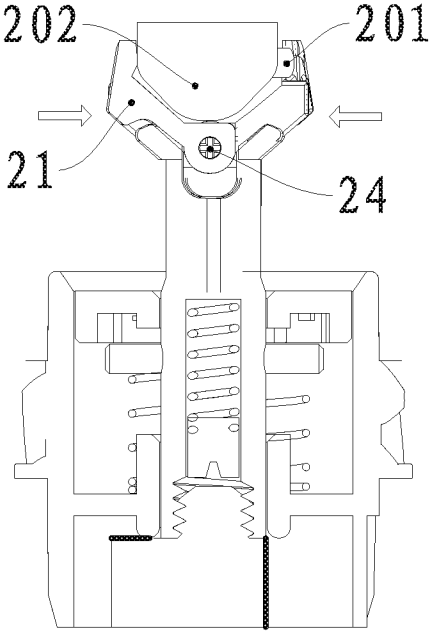

FIGS. 7*a*-7*c* illustrate the movement of the driving assembly relative to the driving shaft, when the developing cartridge is detached from the electrophotographic image forming apparatus. When the developing cartridge is in a working position, as the curved projection 202 pushes against the guide rod 22, under the action of the spring 31, the sleeve 3 axially moves outwardly, namely, the guide rod 22 axially moves the maximum distance inwards relative to the sleeve 3, and the engaging claw is forced to have the minimum deflection angle and further to press against the driving shaft 200 by the protrusion portion 32, so that the driving forces are transmitted stably. When the developing cartridge is taken out of the electrophotographic image forming apparatus along the direction A, the curved projection 202 of the driving shaft 200 pushes the engaging claw 21 to deflect along the direction C, so as to pull the guide rod 22 to move outwards against the biasing force of the spring 23; the deflection angle of the engaging claw 21 increases, and the axial length of the outwardly projecting engaging claw 21 decreases. When the axial movement of the sleeve 3 is not hampered, the sleeve 3 of the connector 2 axially moves into the cylindrical member 1 against the force of the spring 31, and simultaneously, the engaging claw 21 axially swings along the direction C, consequently, the axial length of the outwardly projecting engaging claw 21 decreases, and the engaging claw 21 is released from the radial projection 201 of the driving shaft 200 axially, then the free end of the connector 2 moves in the direction A along the curved projection 202, thereby disengaging from the driving shaft 200; the guide rod 22 axially moves inwards under the action of the spring 23, and the protrusion portion 32 forces the engaging claw 21 to deflect along the direction D to return to its initial position; the sleeve 3 of the connector 2 is pushed outwards under the action of the spring 31. Then the developing cartridge can be taken out of the electrophotographic image forming apparatus. When the axial movement of the sleeve 3 of the connector 2 is hampered, the axial length of the outwardly projecting engaging claws 21 can be reduced through the deflection of the engaging claws 21, so that the connector 2 can be moved along the curved projection 202 of the driving draft 200, thereby detaching the developing cartridge from the electrophotographic image forming apparatus.

Figures 8A, 8B, 8C, 8D:
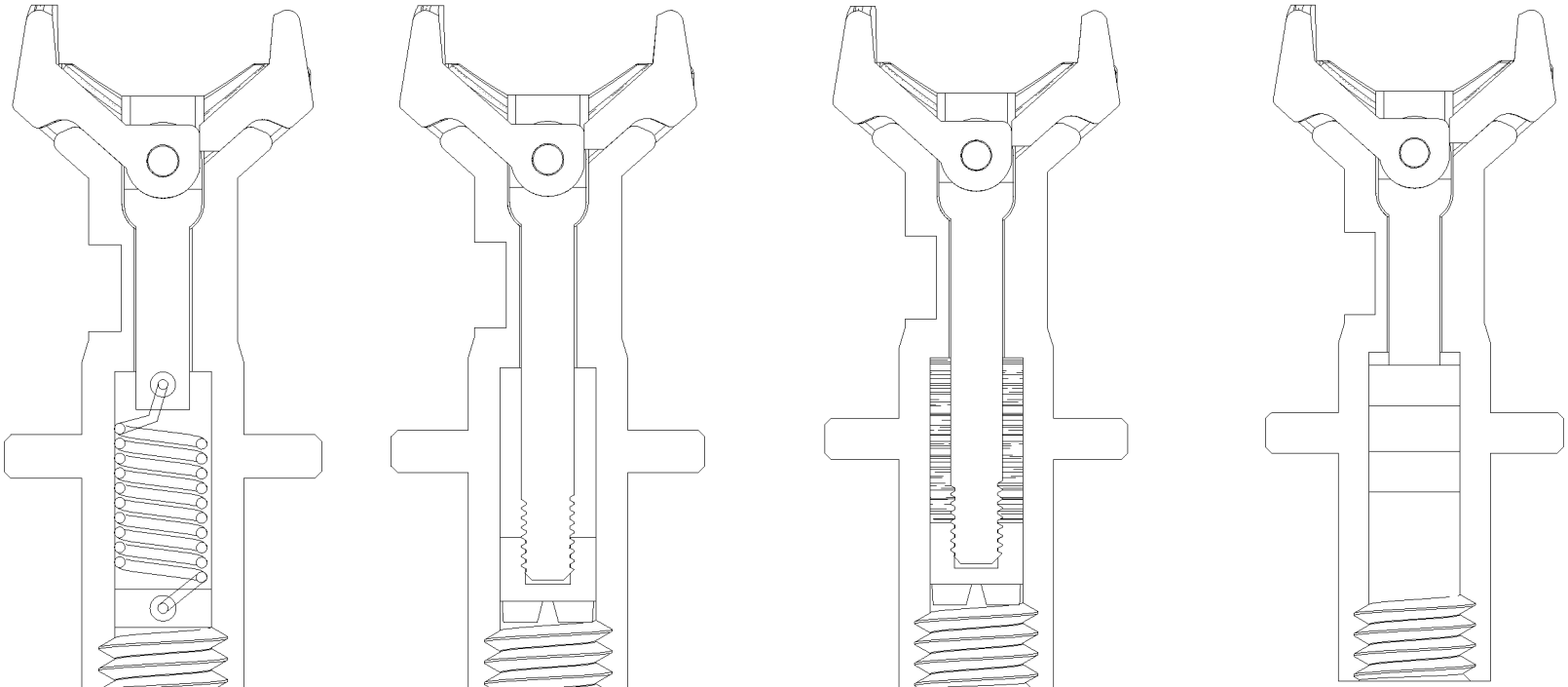
FIGS. 8*a*-8*d* are structural schematic diagrams illustrating other implementations of the connector of the driving assembly of the present disclosure.

FIGS. 8*a*-8*d* illustrate several implementations of the biasing device of the driving assembly. As shown in FIG. 8*a*, the biasing device is a tension spring. The tension spring is connected with the bottom of the sleeve at its one end, and is connected with the end of the guide rod at the other end, so as to exert axial and inwards biasing forces on the guide rod. The biasing device shown in FIG. 8*b* is made of non-metallic elastic material, and can exert inwards or outwards biasing forces on the guide rod in the axial direction. The biasing device 122 shown in FIG. 8*c* is a gas hermetic device or a liquid hermetic device, which is capable of exerting inwards or outwards biasing forces on the guide rod in the axial direction. The biasing device shown in FIG. 8*d* is a magnetic device, and it is appreciated that the position of the magnetic device may be changed, as long as it can exert biasing forces stably. The biasing device of the driving assembly may be one or more of the implementations above. When the biasing device exerts inwards biasing forces on the guide rod, the engaging claws are limited by the sleeve and form a relatively more closed configuration with a smaller deflection angle, consequently, when the projecting engaging claws are at the initial position, the axial length of the projecting engaging claws is relatively larger. When the biasing device exerts outwards biasing forces on the guide rod, the engaging claws form a relatively more open configuration with a larger deflection angle. When the driving assembly engages with the driving shaft, the driving shaft pushes the guide rod to move axially and inwardly, and the engaging claws deflect towards the axis of the guide rod, thereby pressing against the driving shaft and transmitting the driving forces stably.

In other embodiments, only one engaging claw is hinged on the second end of the guide rod through a pivot or a hinge. When a plurality of engaging claws are provided, preferably, the engaging claws are arranged symmetrically with respect to the guide rod. In other embodiments, the biasing device is a spring sheet or other metallic elastic devices.

What is claimed is:

1. A driving assembly, configured to be arranged on one end of a developing cartridge, said driving assembly comprises a connector configured to engage with a driving head of an electrophotographic image forming apparatus, wherein, the connector comprises:

a sleeve, having a protrusion portion at its distal end relative to the developing cartridge, said protrusion portion axially projecting outwards and having a limiting groove with an outwards opening;

a guide rod, having a first end arranged in the sleeve and a second end projecting outwards from the sleeve, said guide rod being coaxial with the sleeve and being capable of reciprocating axially relative to the sleeve; and at least one engaging claw hinged at the second end of the guide rod;

when the driving assembly rotates upon receiving driving forces, a side surface of the limiting groove contacts a side surface of the engaging claw.

2. The driving assembly according to claim 1, wherein:

at least two engaging claws are provided symmetrically with respect to the guide rod;

the engaging claws are hinged at the second end of the guide rod through a pivot or a hinge;

and free ends of the engaging claws axially project outwards along an axis of the guide rod.

3. The driving assembly according to claim 1, wherein:

along with axial and outwards movement of the guide rod, a deflection angle of the engaging claw relative to an axis of the guide rod increases, and axial length of outwardly projecting engaging claw decreases.

4. The driving assembly according to claim 1, farther comprising a cylindrical member configured to be arranged at one end of the developing cartridge, wherein, a force exerting device is provided in the cylindrical member;

the connector has a connecting end arranged inside the cylindrical member and a free end axially projecting outwards from the cylindrical member and out of the developing cartridge; under actions of forces exerted on the connecting end of the connector by the force exerting device, the connector moves axially along an axis of the cylindrical member;

a first limiting structure is configured on the cylindrical member to prevent the connecting end of the connector from dropping out of the cylindrical member.

5. The driving assembly according to claim 1, wherein:

a biasing device is provided in the sleeve to exert axial biasing forces on the guide rod.

6. The driving assembly according to claim 2, wherein:

a biasing device is provided in the sleeve to exert axial biasing forces on the guide rod.

7. The driving assembly according to claim 3, wherein:

a biasing device is provided in the sleeve to exert axial biasing forces on the guide rod.

8. The driving assembly according to claim 4, wherein:

a biasing device is provided in the sleeve to exert axial biasing forces on the guide rod.

9. The driving assembly according to claim 1, wherein:

a second limiting structure is configured on the sleeve or on the guide rod to limit axial movements of the guide rod relative to the sleeve.

10. The driving assembly according to claim 5, wherein: the biasing device is a metallic elastic device, a non-metallic elastic device, a magnetic device, a gas hermetic device, or a liquid hermetic device.

11. The driving assembly according to claim 6, wherein: the biasing device is a metallic elastic device, a non-metallic elastic device, a magnetic device, a gas hermetic device, or a liquid hermetic device.

12. The driving assembly according to claim 7, wherein: the biasing device is a metallic elastic device, a non-metallic elastic device, a magnetic device, a gas hermetic device, or a liquid hermetic device.

13. The driving assembly according to claim 8, wherein: the biasing device is a metallic elastic device, a non-metallic elastic device, a magnetic device, a gas hermetic device, or a liquid hermetic device.

14. A developing cartridge, comprising the driving assembly as defined in claim 1.

15. The developing cartridge according to claim 14, further comprising a photosensitive drum; the driving assembly is arranged at an end of the photosensitive drum; and the guide rod of the driving assembly is coaxial with the photosensitive drum.

16. The developing cartridge according to claim 14, further comprising a developing roller; the driving assembly is arranged at an end of the developing roller; and the guide rod of the driving assembly is coaxial with the developing roller.

17. The developing cartridge according to claim 14, wherein:

at least two engaging claws are provided symmetrically with respect to the guide rod;

the engaging claws are hinged at the second end of the guide rod through a pivot or a hinge;

and free ends of the engaging claws axially project outwards along an axis of the guide rod.

18. The developing cartridge according to claim 14, wherein:

along with axial and outwards movement of the guide rod, a deflection angle of the engaging claw relative to an axis of the guide rod increases, and axial length of outwardly projecting engaging claw decreases.

19. The developing cartridge according to claim 14, further comprising a cylindrical member configured to be arranged at one end of the developing cartridge, wherein, a force exerting device is provided in the cylindrical member;

the connector has a connecting end arranged inside the cylindrical member and a free end axially projecting outwards from the cylindrical member and out of the developing cartridge; under actions of forces exerted on the connecting end of the connector by the force exerting device, the connector moves axially along an axis of the cylindrical member;

a first limiting structure is configured on the cylindrical member to prevent the connecting end of the connector from dropping out of the cylindrical member.

20. The developing cartridge according to claim 14, wherein:

a biasing device is provided in the sleeve to exert axial biasing forces on the guide rod.

* * * * *